US006385031B1

(12) United States Patent
Lerche et al.

(10) Patent No.: US 6,385,031 B1
(45) Date of Patent: May 7, 2002

(54) SWITCHES FOR USE IN TOOLS

(75) Inventors: Nolan C. Lerche, Stafford; James E. Brooks, Manvel, both of TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 09/404,092

(22) Filed: Sep. 23, 1999

Related U.S. Application Data

(60) Provisional application No. 60/101,578, filed on Sep. 24, 1998, provisional application No. 60/101,606, filed on Sep. 24, 1998, provisional application No. 60/109,144, filed on Nov. 20, 1998, and provisional application No. 60/127,204, filed on Mar. 31, 1999.

(51) Int. Cl.[7] ..... F23Q 7/00

(52) U.S. Cl. ..... 361/248; 361/250; 313/602; 200/61.08

(58) Field of Search ..... 361/247–255, 361/257–258, 261, 112; 102/200, 202.5, 202.8, 202.7; 200/181, 51 R, 61.08, 61.4; 313/592, 601–603

(56) References Cited

U.S. PATENT DOCUMENTS

| | | | | |
|---|---|---|---|---|
| 3,181,463 A | | 5/1965 | Morgan et al. | |
| 3,260,810 A | * | 7/1966 | Alston et al. | 200/61.08 |

(List continued on next page.)

FOREIGN PATENT DOCUMENTS

| | | |
|---|---|---|
| EP | 0 029 671 | 9/1983 |
| EP | 0 601 880 A2 | 6/1994 |
| EP | 0 604 694 A1 | 7/1994 |
| EP | 0 675 262 A1 | 10/1995 |
| GB | 677824 | 8/1952 |
| GB | 693164 | 6/1953 |
| GB | 2118282 A | 10/1983 |
| GB | 2100395 B | 8/1984 |
| GB | 2190730 A | 11/1987 |
| GB | 2226872 A | 7/1990 |
| GB | 2265209 | 9/1993 |
| GB | 2290855 A | 1/1996 |
| WO | WO 96/23195 | 8/1996 |
| WO | WO 98/38470 | 9/1998 |

OTHER PUBLICATIONS

"Shock Initiation on PETN," by J. C. Cheng Monsanto Research Corporation, Miamisburg, Ohio, pp. 1–31 through 1–35. (No date).

"Exploding Metallic Foils for Slapper, Fuse, and Hot Plasma Applications: Computational Predictions, Experimental Observations," by I. R. Lindemuth, J. H. Brownell, A. E. Greene, G. H. Nickel, T. A. Oliphant and D. L. Weiss, Thermonuclear Applications Group, Applied Theoretical Physics Division, and W. F. Hemsing and I. A. Garcia, Detonation Systems Group, Dynamic Testing Division, Los Alamos National Laboratory, Los Alamos, New Mexico, pp. 299–305. (No date).

(List continued on next page.)

*Primary Examiner*—Michael J. Sherry
(74) *Attorney, Agent, or Firm*—Trop, Pruner & Hu P.C.

(57) ABSTRACT

A switch for use in various applications, including downhole applications, includes a first conductor and a second conductor and an insulator electrically isolating the first and second conductors. A device responsive to an applied voltage generates a plasma to perforate through the insulator to create an electrically conductive path between the first and second conductors. In another arrangement, a switch includes conductors and at least one element separating the conductors. The at least one element is adapted to electrically isolate the conductors in one state and to change characteristics in response to an applied voltage to provide an electrically conductive path between the conductors. Other types of switches may include electromechanical or mechanical elements.

33 Claims, 5 Drawing Sheets

U.S. PATENT DOCUMENTS

| | | | | | |
|---|---|---|---|---|---|
| 3,269,987 | A | * | 8/1966 | Alston et al. | 200/61.08 |
| 3,327,791 | A | | 6/1967 | Harrigan, Jr. | |
| 3,366,055 | A | | 1/1968 | Hollander, Jr. | |
| 3,517,758 | A | | 6/1970 | Schuster | |
| 3,640,224 | A | | 2/1972 | Petrick et al. | |
| 3,640,225 | A | | 2/1972 | Carlson et al. | |
| 3,641,289 | A | * | 2/1972 | Dokopoulos | 200/61.08 |
| 3,691,631 | A | * | 9/1972 | Bhola | 29/622 |
| 3,932,717 | A | * | 1/1976 | Dike et al. | 200/61.08 |
| 3,953,690 | A | * | 4/1976 | Korr et al. | 200/61.08 |
| 3,978,791 | A | | 9/1976 | Lemley et al. | |
| 4,137,850 | A | | 2/1979 | Donner | |
| 4,307,663 | A | | 12/1981 | Stonestrom | |
| 4,393,779 | A | | 7/1983 | Brede et al. | |
| 4,412,114 | A | * | 10/1983 | Arbeeny | 200/61.08 |
| 4,421,030 | A | | 12/1983 | DeKoker | |
| 4,422,381 | A | | 12/1983 | Barrett | |
| 4,441,427 | A | | 4/1984 | Barrett | |
| 4,471,697 | A | | 9/1984 | McCormick et al. | |
| 4,517,497 | A | | 5/1985 | Malone | |
| 4,527,636 | A | | 7/1985 | Bordon | |
| 4,592,280 | A | | 6/1986 | Shores | |
| 4,602,565 | A | | 7/1986 | MacDonald et al. | |
| 4,632,034 | A | | 12/1986 | Colle, Jr. | |
| 4,638,712 | A | | 1/1987 | Chawla et al. | |
| 4,662,281 | A | | 5/1987 | Wilhelm et al. | |
| 4,680,434 | A | * | 7/1987 | Skogmo et al. | 200/61.08 |
| 4,700,629 | A | | 10/1987 | Benson et al. | |
| 4,708,060 | A | | 11/1987 | Bickes, Jr. et al. | |
| 4,729,315 | A | | 3/1988 | Proffit et al. | |
| 4,735,145 | A | | 4/1988 | Johnson et al. | |
| 4,762,067 | A | | 8/1988 | Barker et al. | |
| 4,777,878 | A | | 10/1988 | Johnson et al. | |
| 4,788,913 | A | | 12/1988 | Stroud et al. | |
| 4,831,933 | A | | 5/1989 | Nerheim et al. | |
| 4,840,122 | A | * | 6/1989 | Nerheim | 102/202.5 |
| 4,843,964 | A | | 7/1989 | Bickes, Jr. et al. | |
| 4,862,803 | A | * | 9/1989 | Nerheim et al. | 102/202.5 |
| 4,886,126 | A | | 12/1989 | Yates et al. | |
| 4,944,225 | A | | 7/1990 | Barker | |
| 5,088,413 | A | | 2/1992 | Huber et al. | |
| 5,094,166 | A | | 3/1992 | Hendley, Jr. | |
| 5,094,167 | A | | 3/1992 | Hendley, Jr. | |
| 5,172,717 | A | | 12/1992 | Boyle et al. | |
| 5,179,248 | A | * | 1/1993 | Hartman et al. | 102/202.4 |
| 5,347,929 | A | | 9/1994 | Lerche et al. | |
| 5,370,054 | A | * | 12/1994 | Reams et al. | 102/202.5 |
| 5,413,045 | A | | 5/1995 | Miszewski | |
| 5,505,134 | A | | 4/1996 | Brooks et al. | |
| 5,520,114 | A | | 5/1996 | Guimard et al. | |
| 5,539,636 | A | | 7/1996 | Marsh et al. | |
| 5,638,946 | A | * | 6/1997 | Zavracky | 200/181 |
| 5,706,892 | A | | 1/1998 | Aeschbacher, Jr. et al. | |
| 5,731,538 | A | | 3/1998 | O'Brien et al. | |
| 5,756,926 | A | | 5/1998 | Bonbrake et al. | |
| 5,909,078 | A | * | 6/1999 | Wood et al. | 310/307 |
| 5,992,326 | A | * | 11/1999 | Martinez-Tovar et al. | 102/202.4 |
| 6,100,477 | A | * | 8/2000 | Randall et al. | 200/181 |

OTHER PUBLICATIONS

"A New Kind of Detonator—The Slapper," by J. R. Stroud Lawrence Livermore Laboratory, University of California, Livermore, California, pp. 22–1 through 22–6. (No date).

"Pyrotechnic Ignition in Minislapper Devices," by D. Grief and D. Powell Awre, Aldermaston, Reading RG7 4PR, Berkshire, England, Controller, HMSO, London, 1981, pp. 43–1 through 43–10. (No month).

"Exploding Foils—The Production of Plan Shock Waves and the Acceleration of Thin Plates," by D. V. Keller & J. R. Penning, Jr. The Boeing Company, Seattle, Washington, pp. 263–277 (No. date).

"Acceleration of Thin Plates by Exploding Foil Techniques," by A. H. Guenther, D. C. Wunsch and T. D. Soapes Pulse Power Laboratory, Physics Division, Research Directorate Air Force Special Weapons Center, Kirtland Air Force Base, New Mexico, pp. 279–298. (No date).

"A Low–Energy Flying Plate Detonator," by A. K. Jacobson Sandia National Laboratories Report, SAND 81–0487C, Albuquerque, New Mexico, 1981, pp. 49–1 through 49–20. (No month).

"Sequential Perforations in Boreholes," by H. Lechen ANTARES Datensysteme GmbH, Jan. 1998.

"A Simple Method for Estimating Well Productivity," by J. E. Brooks, SPE European Formation Damage Conference, The Hague, The Netherlands, Jun. 2–3, 1997.

"Unique Features of SCBs," by P. D. Wilcox and "SCB Explosive Studies" by R. W. Bickes, Jr. Initiating and Pyrotechnic Components Division 2515.

"Performance Criteria for Small Slapper Detonators" Controller, Her Majesty's Stationery Office, London 1984 1984 (No month).

"New Developments in the Field of Firing Techniques" by K. Ziegler Propellants, Explosives, Pyrotechnics 12, 115–120 (1987) (No month).

"Application of Slapper Detonator Technology to the Design of Special Detonation Systems," by W. H. Meyers Proc. 12$^{th}$ Symposium on Explosives and Pyrotechnics, San Diego, California, Mar. 13–15, 1984, Detonation Systems Development, Los Alamos National Laboratory, pp. 4–5 through 4–19.

"CP DDT Detonators: II. Output Characterization," by M. L. Lieberman Sandia National Laboratories Report SAND 83–1893 Albuquerque, New Mexico, pp. 3–105 through 3–112 (No date).

"A Fast, Low Resistance Switch for Small Slapper Detonators," by D. D. Richardson and D. A. Jones Department of Defense Materials Research Laboratories Report MRL–R–1030, Victoria, Australia. (No date).

"The Effect of Switch Resistance on the Ringdown of a Slapper Detonator Fireset," by D. D. Richardson Department of Defense Materials Research Laboratories Report MRL–R–1004, Victoria, Australia. (No date).

"Flyer Plate Motion and Its Deformation During Flight," by H. S. Yadav and N. K. Gupta Int. J. Impact Engng. vol. 7, No. 1, 1988, pp. 71–83 (No month).

"Mossbauer Study of Shock–Induced Effects in the Ordered Alloy $Fe_{50}Ni_{50}$ In Metorites," By R. B. Scorzelli, I. S. Azevedo, J. Danon and Marc A. Meyers J. Phys. F: Met. Phys. 17 (1987), pp. 1993–1997. (No month).

"Effect of Shock–Stress Duration on the Residual Structure and Hardness of Nickel, Chromel, and Inconel," by L. E. Murr and Jong–Yuh Huang Materials Science and Engineering, 19 (1975), pp. 115–122. (No month).

"High–Temperature–Stable Detonators," by R. H. Dinegar Proc. 12$^{th}$ Symposium on Explosives and Pyrotechnics, Sand Diego, California, Mar. 13–15, 1984, Los Alamos National Laboratory, pp. 4–1 through 4–4.

James E. Brooks, A Simple Method for Estimating Well Productivity, Society of Petroleum Engineers 1–8 (Jun. 2–3, 1997).

* cited by examiner

SWITCHES FOR USE IN TOOLS

This application claims priority under 35 U.S.C. § 119(e) to U.S. Provisional Patent Application Ser. No. 60/101,578, entitled "Initiators Used in Explosive Devices," filed Sep. 24, 1998; U.S. Provisional Patent Application Ser. No. 60/101,606, entitled "Switches Used in Tools," filed Sep. 24, 1998; U.S. Provisional Patent Application Ser. No. 60/109,144, entitled "Switches for Use in Tools," filed Nov. 20, 1998; and U.S. Provisional Patent Application Ser. No. 60/127,204, entitled "Detonators for Use With Explosive Devices," filed Mar. 31, 1999.

BACKGROUND

The invention relates to switches for use in tools, such as downhole tools in wellbores.

In completing a well, different types of equipment and devices are run into the well. For example, a perforating gun string can be lowered into a wellbore proximal a formation that contains producible fluids. The perforating string is fired to create openings in surrounding casing as well as to extend perforations into the formation to establish production of fluids. Other completion devices that may be run into a wellbore include packers, valves, and other devices.

Electrical activation devices may be used to activate such completion devices, such as to fire a perforating gun, to set a packer, or to open or close a valve. Such electrical activation devices typically include switches that may be triggered to a closed position to electrically couple two components. In wellbore applications, the most common type of switch is made from a gas discharge tube that is either a triggered-type or over-voltage type switch. A triggered-type switch requires an external stimulus to close the switch or to activate it. An over-voltage switch is activated whenever the voltage level on one side of the switch exceeds a threshold value.

Conventional switches are constructed using a gas tube having an electrode on each end. In order to make the switch conduct, either a trigger voltage must be applied to a third internal grid or anode, or the switch is forced into conduction as a result of an over-voltage condition. The over-voltage switch, once manufactured, cannot be made to trigger at less than a preset voltage. It would be desirable to be able to trigger an over-voltage switch at a selectable lower voltage in order to perform margin testing on the system.

Further, the typical gas tube discharge switch is arranged in a tubular geometry, which is not conducive to achieving a switch having a low inductance (and thus low triggering voltage). Also, the tubular shape of a gas tube does not allow convenient reduction of the overall size of a switch. Additionally, it may be difficult to integrate the gas tube switch with other components.

Another type of switch includes an explosive shock switch. The shock switch is constructed using a flat flexible cable having a top conductor layer, a center insulator layer (made of KAPTON® for example), and a bottom conductor layer. A small explosive is detonated on the top layer causing the KAPTON® insulator layer to form a conductive ionization path between the two conductor layers. One variation of this is a "thumb-tack" switch in which a sharp metal pin is used to punch through the insulator layer to electrically connect the top conductor layer to the bottom conductor layer.

The explosive shock switch offers a low inductance switch but an explosive pellet must ignite to trigger the switch. The thumb tack switch is similar to the explosive switch but it may be relatively difficult to actuate. Thus, a need continues to exist for switches having improved reliability and triggering characteristics.

SUMMARY

In general, according to one embodiment, a switch includes first and second conductors and an insulator electrically isolating the conductors. A device is responsive to an applied voltage to generate a plasma to perforate through the insulator to create an electrically conductive path between the first and second conductors.

Other features and embodiments will become apparent from the following description and from the claims.

DETAILED DESCRIPTION

In the following description, numerous details are set forth to provide an understanding of the present invention. However, it is to be understood by those skilled in the art that the present invention may be practiced without these details and that numerous variations or modifications from the described embodiments may be possible. For example, although reference is made to activating exploding foil initiators (EFIs), switches in accordance with some embodiments may be employed to activate components in other types of tools or devices. In addition, although reference is made to specific voltage and capacitance values, further embodiments may employ lower or higher voltage or capacitance values.

As used here, the terms "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right or right to left relationship as appropriate.

Figure 1:
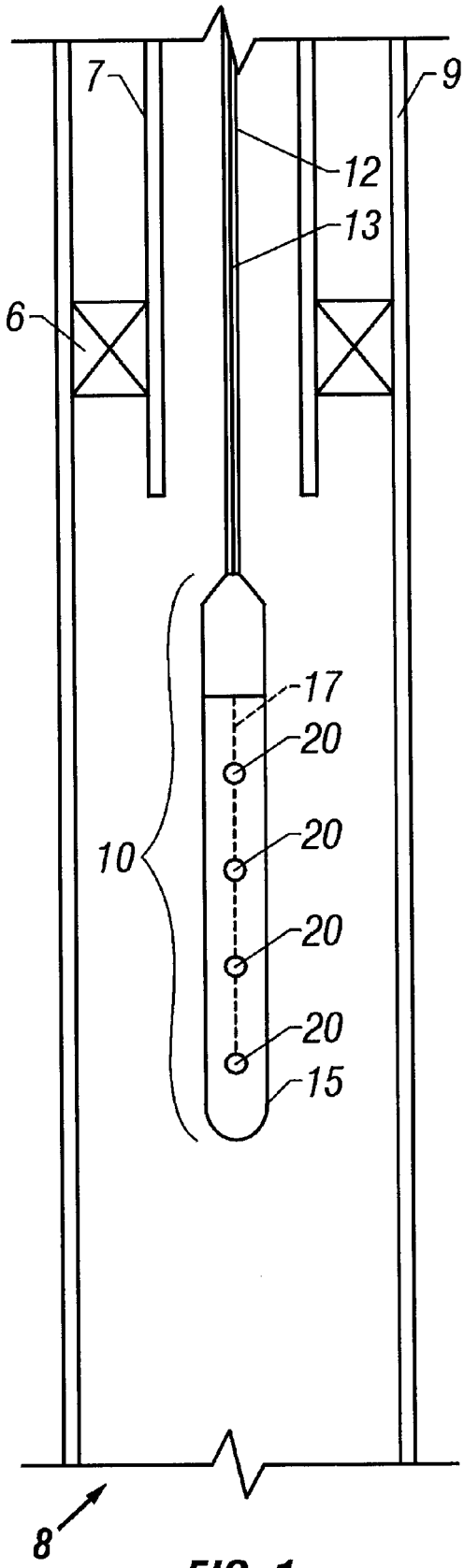
FIG. 1 illustrates an embodiment of a tool string for use in a wellbore.

Referring to FIG. 1, a downhole tool 10, which may include a perforating gun 15 in one example, is lowered down through a tubing 7 that is positioned in a wellbore 8 lined with casing 9. A packer 6 is set between the tubing 7 and the casing 9 to isolate the tubing-casing annulus. The downhole tool 10 is run on a carrier 12, which may include a wireline, slickline, or tubing. Certain types of carriers 12 (such as wirelines) may include one or more electrical conductors 13 over which power and signals may be communicated to the downhole tool 10. The perforating gun 15 shown in FIG. 1 includes a plurality of shaped charges 20. In one embodiment, such shaped charges may be detonated by use of initiator devices that are activated by a command issued from the well surface, which may be in the form of electrical signals sent over the one or more electrical conductors 13 in the carrier 12. Alternatively, the command may be in the form of pressure pulse commands or hydraulic commands.

Other embodiments of the downhole tool 10 may include packers, valves, or other devices. Thus, the command issued from the well surface may activate control modules to set the packers, to open and close valves, or to actuate other devices. To activate a device in the downhole tool 10, switches may be provided in initiator devices or control modules to connect an electrical signal or electrical power to the device. For example, to initiate an explosive, an initiator device may include a switch and an exploding foil initiator (EFI) circuit. The switch is adapted to close to couple electrical power to the EFI circuit to activate the EFI circuit. In control modules for other types of downhole devices, switches may similarly be used to couple electrical power to components in the devices.

Some embodiments according to the invention include switches having relatively high slew rate, low inductance, and low resistance for enhanced efficiency. The switches may also be capable of operating under relatively high voltage and high current conditions. Such switches may be suitable for use in initiator devices such as capacitor discharge unit (CDU) fire sets having EFI circuits. The switches may include the following types: plasma switches, fuse link switches, over-voltage switches having an external trigger anode, conductor/insulation/conductor over-voltage switches, microelectromechanical switches, and other types of switches.

A plasma shock switch is similar to the conventional explosive shock switch except that an electrically induced plasma from the breakdown of silicon (or other suitable material) is used instead of an explosive. In one embodiment, a diode "explodes" (that is, avalanches) whenever the applied voltage exceeds a predetermined value to connect the conductor on the top layer to the conductor on the bottom to close the switch.

A fuse link switch may be constructed on a support structure (e.g., a ceramic substrate) with the two conductors separated by a gap. Between the gap is the fuse link that may have one side common to one of the conductors. The entire assembly is covered with a deposited insulator (e.g., polyimide). The switch is triggered by inducing sufficient power into the fuse link to disrupt the insulation path and cause the two separated anodes to conduct to thereby close the switch.

Another type of switch is an over-voltage switch that is externally modified to allow the switch to be triggered at a voltage lower than its normal over-voltage firing level. A trigger anode is added to the normal over-voltage switch by wrapping a thin electrically conductive wire around the body (which is formed of an electrically insulating material) of the switch. Transmitting a trigger signal to the added anode in combination with an applied high voltage triggers the switch.

The conductor/insulation/conductor (e.g., copper/polyimide/copper) switch is an over-voltage switch not requiring a separate trigger signal. This switch may be constructed on a support structure (e.g., ceramic substrate) and has two electrically conductive layers separated by a thin insulator. The insulator thickness is sized to break down at a predetermined voltage. Upon application of sufficient voltage, the insulator layer breaks down to close the switch to permit conduction between the two conductor layers. Other types of switches include a microelectromechanical switch and a pressure actuated switch, each including a multi-layered assembly of a plurality of conductor layers and at least one insulator layer. Each of the microelectromechanical and mechanical switches include members capable of piercing the at least one insulator layer to electrically couple conductor layers.

One advantage of switches according to some embodiments is that the switches can be integrated with EFI circuits (or other types of initiators) to provide smaller initiator device packages. As used here, components are referred to as being "integrated" if they are formed on a common support structure, placed in packaging of relatively small size, or otherwise assembled in close proximity to one another. Thus, a switch may be fabricated on the same support structure as the EFI circuit to provide a more efficient switch because of lower effective series resistance (ESR) and effective series inductance (ESL).

Figure 2:
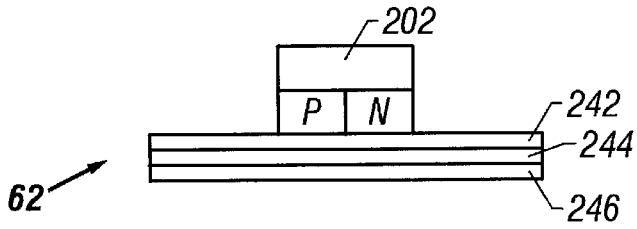
FIGS. 2–5 illustrate an embodiment of a plasma switch.

Referring to FIG. 2, a plasma-diode switch 62 is similar to a conventional explosive shock switch with the main difference being that a Zener diode 202 (or some other device with a P/N junction formed in doped silicon or some other suitable semiconductor material, such as germanium) is used instead of an explosive to establish the connection of two conductor layers 242 and 246. The Zener diode 202 may be electrically attached to the top conductor layer 242. The P/N junction of the diode 202 faces the conductor layer 242, which may be at ground potential. The conductor layers 242 and 246 (each including a metal such as copper, aluminum, nickel, steel, tungsten, gold, silver, a metal alloy and so forth) sandwich an insulator layer 244 (which may include polyimide, such as KAPTON® or Pyralin). The Zener diode 202 is forced into an avalanche condition by applying a voltage greater than that required to break down the P/N junction of the diode 202. This generates a plasma that perforates a hole through the layers of the switch 62. The plasma creates a conductive path between the conductor layers 242 and 246, causing the switch 62 to close and conduct for the duration required to electrically couple elements across the switch 62. For example, electrical power may be coupled from one node of the switch 62 to another node of the switch.

The switch 62 may be fabricated using two thin electrically conductive plates (e.g., copper) which form the conductor layers 242 and 246 separated by the insulator layer 244 (e.g., KAPTON®). In one example arrangement, the copper layers 242 and 246 may each be about 1 mil thick while the KAPTON® layer 244 may be about 0.5 mils thick.

Figure 3:
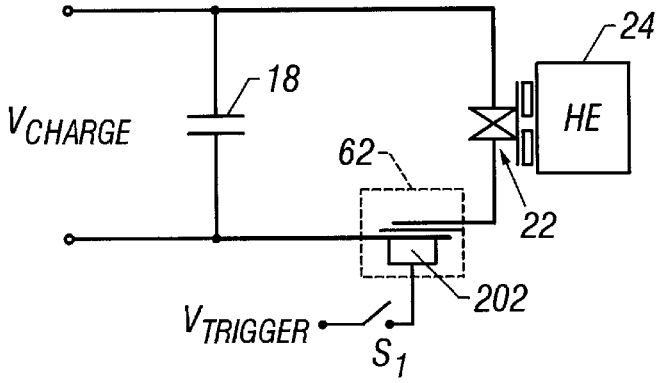

Referring to FIG. 3, a schematic diagram illustrates the diode switch 62 arranged in an initiator device such as a capacitor discharge unit (CDU). In normal operation, a slapper capacitor 18 (which may have a capacitance of about 0.08 $\mu$F, for example) is charged by a charging voltage $V_{CHARGE}$ that may be set at about 800–1500 volts DC (VDC), for example. The charging voltage $V_{CHARGE}$ may be provided over a first charge line. A trigger line may provide a triggering voltage $V_{TRIGGER}$, which may be set at a voltage between about 200–500 VDC, for example. When a switch S1 is closed, the switch S1 initiates a current flow into the diode 202, causing it to avalanche. In another arrangement, the switch S1 may be omitted, with the trigger line $V_{TRIGGER}$ coupled directly to the diode 202. The diode switch 62 including the Zener diode 202 and layers 242, 244, and 246 is then closed, which allows energy from the slapper capacitor 18 to be dumped rapidly into an initiator 22, which may be an EFI circuit, for example. Activation of the initiator then detonates a high explosive (HE) 24.

Figure 4:
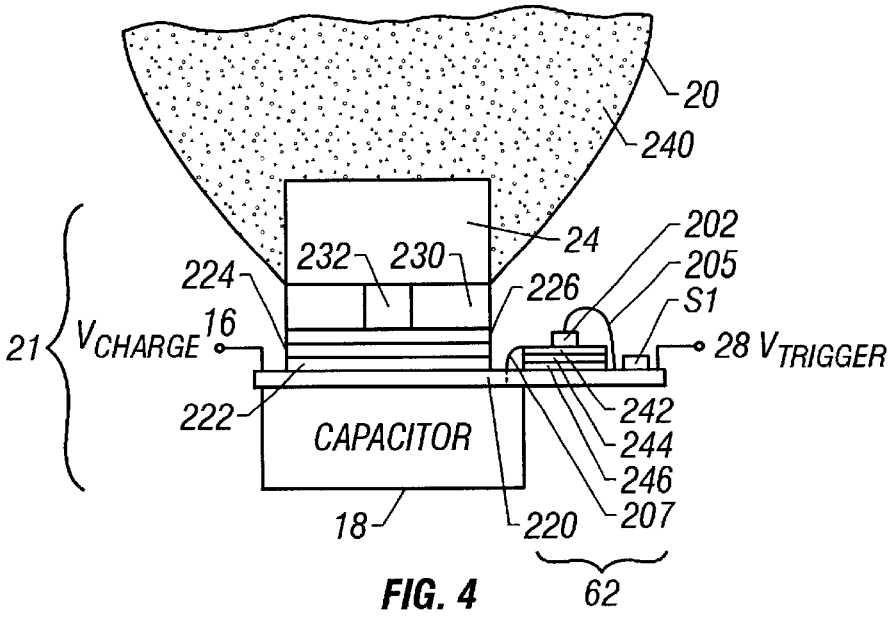

Referring to FIG. 4, an arrangement of an initiator device 21 with an explosive device 20 is illustrated. The initiator device 21 may be a CDU having the EFI circuit 22 and a plasma diode switch in accordance with an embodiment. The EFI circuit 22 may be composed of relatively thin (submicron tolerance) deposited layers of an insulator 222, conductor 224, and insulator 226. In one embodiment, the insulator layers 222 and 226 may be formed of polyimide (e.g., KAPTON® or Pyralin), and the conductor layer 224 may be formed of a metal such as copper, aluminum, nickel, steel, tungsten, gold, silver, a metal alloy, and so forth. The layers 222, 224, and 226 forming the EFI circuit 22 may be formed on a support structure 220 (which may be formed of a material including ceramic, for example). In an alternative embodiment, the bottom insulator layer 222 of the EFI circuit 22 may be part of the support structure 220. The thinner, outer insulator layer 226 serves as a flyer or slapper that initiates the secondary high explosive 24, which may be HNS4, NONA, or other explosives. Upon activation of the EFI circuit 22, the flyer that breaks off the top insulator layer 226 flies through a barrel 232 in a spacer 230 to impact the high explosive 24. The high explosive 24 is in contact with the explosive 240 of the shaped charge 20. Detonation of the high explosive 24 initiates the shaped charge explosive 240 (or other explosive).

As an alternative, the flyer can be a composite of an insulating layer (e.g., KAPTON® or Pyralin) and a metal, such as aluminum, copper, nickel, steel, tungsten, gold, silver, a metal alloy, and so forth. The efficiency of the EFI circuit 22 is enhanced by building the EFI circuit 22 with thin layers of metal and polyimide. A thin metalization layer is compatible with the lower ESL (equivalent series inductance) of the CDU.

Figure 5:
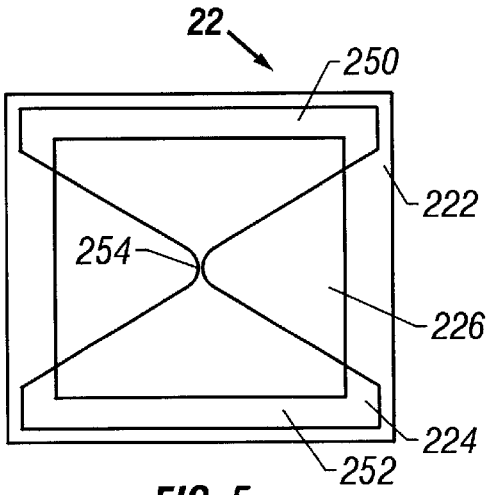

Referring to FIG. 5, a top view of the EFI circuit 22 according to the FIG. 4 embodiment is illustrated. The conductor layer 224 (which may be formed of a metal foil) sits on the bottom insulator layer 222. The conductor layer 224 includes two electrode portions 250 and 252 and a reduced neck portion 254. The top insulator layer 226 (which may be formed of polyimide or other insulator) covers a portions of both the conductor layer 224 (including the neck portion 254) and the bottom insulator layer 222. A voltage applied across electrodes 250 and 252 causes current to pass through the neck portion 254. If the current is of sufficient magnitude, the neck portion 254 may explode or vaporize and go through a phase change to create a plasma. The plasma causes a portion (referred to as the flyer) of the layer 226 to separate from and fly through the barrel 232. In one example embodiment, a flyer velocity of about 3 mm/us may be achieved.

The EFI circuit 22 described is a "flyer plate" type EFI circuit. In alternative embodiments, the EFI circuit may include other types, such as an exploding foil "bubble activated" initiator. An example of a bubble activated EFI is disclosed in U.S. Pat. No. 5,088,413, by Huber et al., which is hereby incorporated by reference. In the bubble activated EFI, a polyimide bubble is created instead of a flyer to initiate an explosive.

Another type of initiator includes an exploding bridgewire (EBW) initiator, which includes a wire (the bridge) through which a high current is conducted. The high current causes the wire to explode to create intense heat and shock wave to initiate an explosive that is placed around the wire. The EFIs and EBW initiators are bridge-type initiators in which high energy is dumped through a bridge (a wire or narrowed section of a foil) to explode or vaporize the bridge, which provides energy to detonate an explosive by a flyer, bubble, or shock wave.

The switching circuit 62 including the diode switch as shown in FIG. 2 may be integrated with the EFI circuit 22 or other type of initiator on the same support structure 220. The upper conductor layer 242 of the switch 62 is electrically coupled to one node of the slapper capacitor 18 (over a wire 207). The upper conductor layer 242 also abuts the Zener diode 202. The lower conductor layer 246 is electrically coupled to one electrode of the EFI circuit 22, such as through conductive traces in the support structure 220. The diode 202 breaks down in response to an applied voltage (over a wire 205) when the trigger line $V_{TRIGGER}$ activates a switch S1. In another embodiment, the switch S1 may be omitted, with the diode 202 coupled to the trigger line $V_{TRIGGER}$. The applied voltage on $V_{TRIGGER}$ may be set at greater than the breakdown voltage of the diode 202, which causes it to avalanche as it conducts current in response to the applied voltage, providing a sharp current rise and an explosive burst that punches through the upper conductor layer 242 and the insulation layer 244 to make an electrical connection path to the lower conductor layer 246 to close the circuit from the slapper capacitor 18 to the EFI circuit 22. This configuration is, in effect, a high-efficiency triggerable switch. There are also other switch embodiments that may be used.

The plasma switch 62 offers the advantage that it can be implemented in a relatively small package. With a smaller assembly, the ESR and ESL of the switch is reduced, which leads to enhanced efficiency of the switch. The plasma switch may also be integrated onto the same support structure as the device it connects to, such as an EFI circuit. This leads to an overall system, such as an initiator device, having reduced dimensions. By using a semiconductor material doped with a P/N junction (such as a diode) to create a plasma to form a conduction path through several layers of the switch, reliability is enhanced over conventional explosive shock switches since an explosive is not needed.

Figure 6:
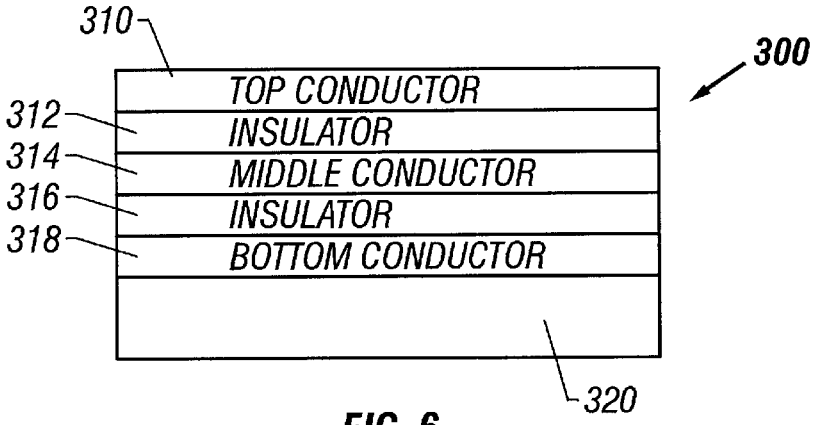
FIGS. 6–7 illustrate another embodiment of a plasma switch.
Figure 7:
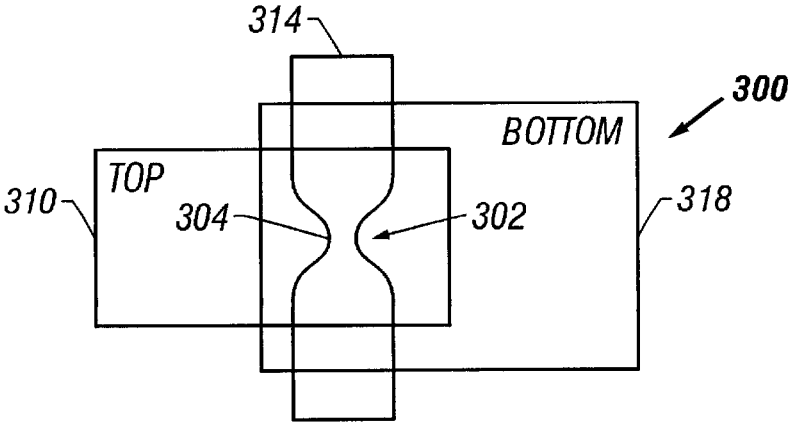

The plasma switch of FIGS. 2–5 includes a switch 62 having a Zener diode 202 and a conductor/insulator/conductor assembly including layers 242, 244, and 246. Another embodiment of a plasma switch (300) is shown in FIGS. 6 and 7. The plasma switch 300 includes a bridge 302 that may be formed of metal, such as copper, aluminum, nickel, steel, tungsten, gold, silver, and so forth. The bridge 302 is used in place of a silicon P/N junction such as that in the Zener diode 202 in the plasma diode switch 62 of FIG. 4. The bridge 302 includes a reduced neck region 304 (with a reduced electrically conductive area) that explodes or vaporizes (similar to the reduced neck section of an EFI circuit) to form a plasma when sufficient electrical energy is dumped through the reduced neck region 304. As shown in FIG. 6, the switch 300 may include five layers: a top conductor layer 310, a first insulator layer 312, an intermediate conductor layer 314 forming the bridge 302, a second insulator layer 316, and abottom conductor layer 318. The top, intermediate and bottom conductor layers 310, 314, and 318 may be formed of a metal. The insulator layers 312 and 316 may be formed of a polyimide, such as KAPTON® or Pyralin, as examples. The switch 300 may be formed on a supporting structure 320 similar to the support structure 220 in FIG. 4.

When sufficient energy (in the form of an electrical current) is provided through the bridge 302, the reduced region 304 explodes or vaporizes such that plasma perforates through the insulator layers 312 and 316 to electrically couple the top and bottom conductors 310 and 318. In one example embodiment, the layers may have the following thicknesses. The conductor layers 310, 314, and 318 may be approximately 3.1 micrometers ($\mu$m) thick. The insulator layer 312 and 316 may each be approximately 0.5 mils thick. The dimensions of the reduced neck region 304 may be approximately 4 mils by 4 mils.

In an alternative arrangement of the switch 300, the bridge may be placed over a conductor-insulator-conductor switch. The bridge may be isolated from the top conductor layer by an insulating layer. Application of electrical energy would explode or vaporize the bridge, connecting the top conductor to the bottom conductor.

Figure 8:
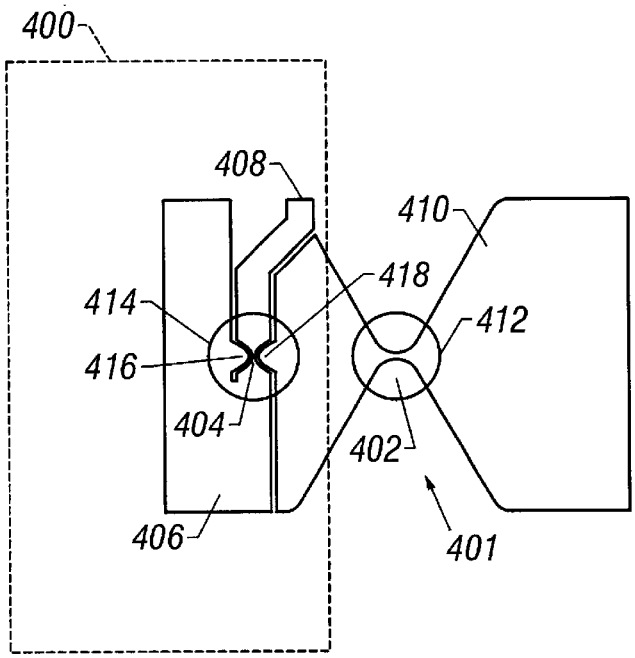
FIGS. 8–9 illustrate an embodiment of a fuse link switch.
Figure 9:
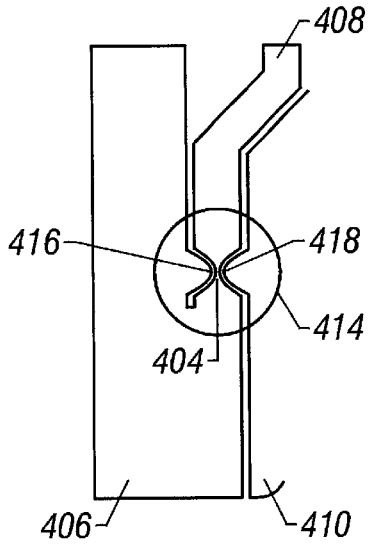

Referring to FIGS. 8 and 9, according to another embodiment, a fuse link switch 400 may be manufactured on a support structure (e.g., a ceramic substrate) and can be integrated with an initiator 401, such as an EFI circuit. In one embodiment, copper may be vacuum deposited or sputtered onto the ceramic substrate and a mask is used to etch the pattern shown in FIG. 8. One end of a fuse link 404 is electrically connected to a first conductor 406 and the other end of the fuse link 404 is connected to a trigger electrode 408 (which may be coupled to the trigger line $V_{TRIGGER}$). The fuse link 404 is also coated with a polyimide cover 414, which acts as an electrical insulator to prevent electrical conduction between the conductor 406 and a second conductor 410.

The fuse link switch 400 may have the following specific dimensions according to one example embodiment. The fuse link 404 may be about 9 mils×9 mils in dimension. The fuse link 404 may be formed of one or more metal layers, e.g., a first layer of copper (e.g., about 2.5 $\mu$m) and a second layer of titanium (e.g., about 0.05 $\mu$m thick). The insulation cover 414 may be spin-on polyimide (e.g., about a 10-$\mu$m thick layer of P12540 polyimide). Electrodes 416 and 418 formed in the first and second conductors 406 and 410, respectively, may be coated with tungsten or other similar hardened metal. Spacing between the fuse link 404 and the electrodes 416 and 418 on either side may be of a predetermined distance, such as about 7 mils.

In operation, when an electric potential is placed across the conductors 406 and 410, no current flows between the two conductors because of the insulation cover 414 between them. However, if a sufficiently high voltage is applied at the trigger electrode 408, a phase change within the fuse link area may be induced. The heating effects of the fuse link 404 in turn breaks down the dielectric of the insulation cover 414, which when coupled with the phase change of the fuse link 404 creates a conductive path between the electrodes 416 and 418. This in effect closes the switch 400 to allow current between the conductor 406 and the conductor 410. A high current passing through a narrowed neck section 402 of the EFI conductor 410 causes vaporization of the neck section 402 to shear a flyer from layer 412 (e.g., a polyimide layer).

Figure 10:
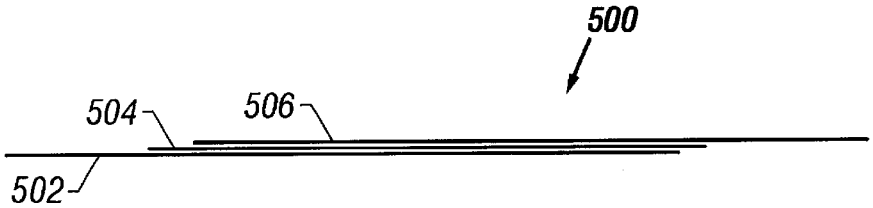
FIG. 10 illustrates an embodiment of an over-voltage switch.

Referring to FIG. 10, according to another embodiment, an over-voltage switch 500 formed of a conductor/insulator/conductor structure may be used. The switch 500 includes a first conductor layer 502, an intermediate insulator layer 504, and a second conductor layer 506 that are formed of copper, polyimide and copper, respectively, in one example embodiment. The layers may be deposited onto a ceramic support structure. When a sufficient voltage is applied across conductor layers 502 and 506, breakdown of the insulating layer 504 may occur. The breakdown voltage is a function of the thickness of the polyimide layer 504. A 10-$\mu$m thick layer may break down around 3,000 VDC, for example. Breakdown of the insulator layer 504 causes a short between the conductor layers 502 and 506, which effectively closes the switch 500.

In another arrangement of the switch 500, each of the conductor layers 502 and 506 may include two levels of metal (e.g., about 2.5 $\mu$m of copper and 0.05 $\mu$m of titanium). The insulator layer 504 may include polyimide, such as KAPTON® or Pyralin.

More generally, in each of the switches according to the FIGS. 8–10 embodiments, at least one element separates two conductors. The at least one element is adapted to electrically isolate the conductors in one state and to change characteristics in response to an applied voltage to provide an electrically conductive path between the conductors.

Figure 11:
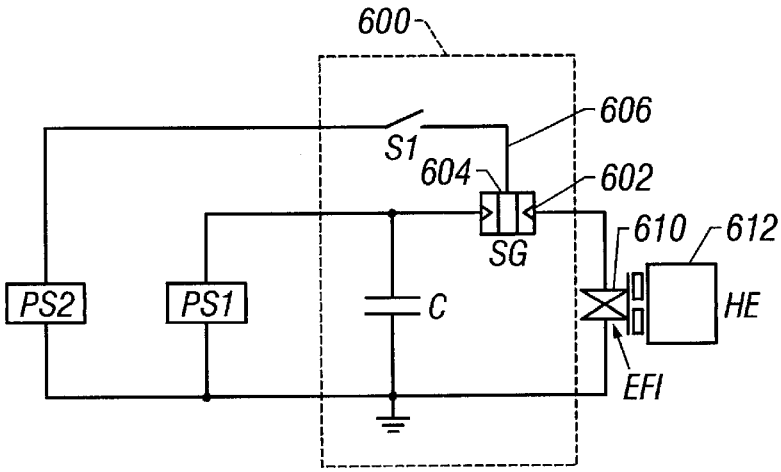
FIG. 11 illustrates another embodiment of an over-voltage switch.

Referring to FIG. 11, which discloses yet another embodiment of a switch, a conventional over-voltage switch 600 may be modified such that it triggers at a voltage lower than its normal breakdown voltage. A wire 604 may be wound around a conventional spark gap 602 to provide a plurality of windings. One end of the wire 604 is floating and the other end is connected to a trigger anode 606 (connected to the trigger line 28, for example). A first supply voltage PS1 is set at a value that is below the firing voltage of the spark gap 602. A second supply voltage PS2 is set at a voltage that is to sufficient to ionize the spark gap 602 and cause the spark gap 602 to go into conduction. The voltage required is a function of the value difference between the supply voltage PS1 and the normal trigger voltage of the spark gap 602 and the number of turns of the wire 604 around the spark gap 602. In one example, for a 1400-volt spark gap 602 with a supply voltage PS1 set at about 1200 volts, the number of turns of wire 604 around the spark gap 602 may be six. The supply voltage PS2 may be set at about 1000 volts. Upon closure of a switch S1, the spark gap 602 goes in conduction and dumps the capacitor charge into an EFI circuit 610, which in turn activates a high explosive (HE) 612. An advantage offered by this type of switch is that margin testing can be performed on an activation device, such as a CDU.

Figure 12:
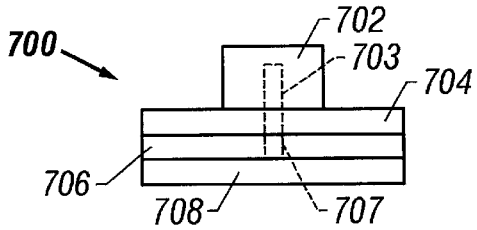
FIG. 12 illustrates an embodiment of a microelectromechanical switch.

Referring to FIG. 12, according to yet another embodiment, a mechanical switch 700 that is activable by a microelectromechanical system 702 may be utilized. In this embodiment, the microelectromechanical system replaces the thumbtack actuator used in conventional thumbtack switches. The switch 700 includes top and bottom conductor layers 704 and 708 sandwiching an insulating layer 706. The conductors 704 and 708 may each be formed of a metal. The insulator layer 706 may include a polyimide layer. The microelectromechanical system 702 may be placed over the top conductor layer 704. When actuated, such as by an applied electrical voltage having a predetermined amplitude, an actuator 703 in the microelectromechanical system 702 moves through the layers 704 and 706 to contact the bottom conductor layer 708. This electrically couples the top and bottom conductors 704 and 706 to activate the switch 700. In one embodiment, an opening 707 may be formed through the layers 704 and 706 through which the actuator 703 from the microelectromechanical system 702 may travel. In another embodiment, the actuator from the microelectromechanical system 702 may puncture through the layers 704 and 706 to reach the layer 708.

Figure 13:
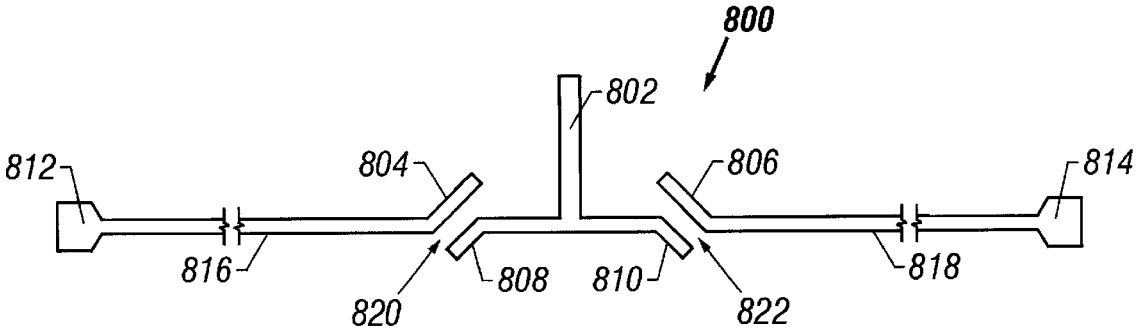
FIG. 13 illustrates another embodiment of a microelectromechanical switch.

Referring to FIG. 13, in another embodiment, a microelectromechanical switch 800 may include electrical contacts 804, 806, 808, and 810 separated by gaps 820 and 822. Contacts 804 and 806 are electrically coupled to lines 816 and 818, respectively, which terminate at electrodes 812 and 814, respectively. The electrodes 812 and 814 may be electrically contacted to corresponding components, such as to an energy source and a device to be activated by the energy source. The contacts 804 and 806 are slanted to abut against contacts 808 and 810, respectively, when the contacts 808 and 810 are moved upwardly by an actuator member 802. The actuator member 802 may be moveable by application of a trigger voltage, for example. When the contacts 804, 806, 808, and 810 are contacted to one another, an electrically conductive path is established between the electrodes 812 and 814.

The contacts 804, 806, 808, and 810 may be formed of a metal or other electrically conductive material. The switch 800 may be formed in a semiconductor substrate, such as silicon.

Figure 14:
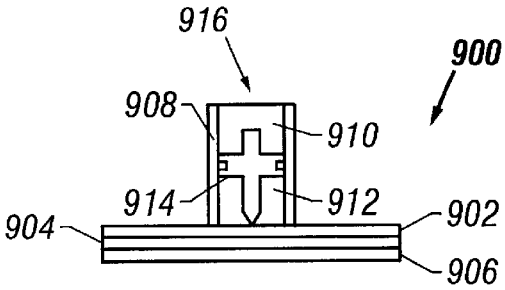
FIG. 14 illustrates an embodiment of a mechanical switch activable by fluid pressure.

Referring to FIG. 14, an embodiment of a mechanical switch 900 is illustrated. The switch 900 includes a rod 914 that is actuated by fluid pressure in a chamber 914. The chamber 914 and the rod 914 are contained in a housing 908 that is placed over a layered assembly including an upper conductor layer 902, an intermediate insulator layer 904, and a lower conductor layer 906. The rod 914 includes a flanged portion that is sealed against the inner wall of the housing 908 to define a reference pressure chamber 912. A sufficiently large differential pressure between chambers 910 and 912 will move the rod downwardly so that the sharp tip of the rod 914 punctures through the conductor and insulator layers 902 and 904 to make electrical contact with the lower conductor layer 906. The rod 914, which may be formed of an electrically conductive material such as metal, then provides an electrically conductive path between the upper and lower conductor layers 902 and 906.

Another type of mechanical switch may use a memory alloy metal that is moveable to punch through the two conductors under the application of heat generated by an electrical current.

Advantages of the various switches disclosed may include the following. Generally, the switches may be implemented in relatively small assemblies, which improves the efficiency of the switches due to reduced resistance and inductance. Further, some of the switches may be integrated with other devices, such as EFI circuits, to form an overall package that is reduced in size. Reliability and safety of the switches are enhanced since explosives or mechanical actuation as used in some conventional switches are avoided.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A switch comprising:

a first conductor and a second conductor;

an insulator electrically isolating the first and second conductors; and a device responsive to an applied voltage to generate a plasma to perforate through the insulator to create an electrically conductive path between the first and second conductors.

2. The switch of claim 1, wherein the device includes a P/N junction.

3. The switch of claim 2, wherein the device includes a diode.

4. The switch of claim 3, wherein the device includes a Zener diode.

5. The switch of claim 1, wherein the device includes a bridge having a reduced neck section placed proximal the first conductor.

6. The switch of claim 5, wherein the neck section is adapted to vaporize to create the plasma in response to an applied current.

7. The switch of claim 1, wherein the conductors and insulator are arranged as first and second conductor layers and an insulator layer between the first and second conductor layers.

8. The switch of claim 7, wherein each of the conductor layers may include a material selected from a group consisting of copper, aluminum, nickel, steel, tungsten, gold, silver, and a metal alloy.

9. The switch of claim 7, wherein the insulator layer includes polyimide.

10. The switch of claim 9, wherein the polyimide is selected from a group consisting of KAPTON®, Pyralin, and P12540.

11. A tool for use in a wellbore, comprising:

a downhole component activable by electrical power; and a switch coupled to the downhole component, the switch selected from the group consisting of:

(a) an assembly having a first conductor and a second conductor; an insulator electrically isolating the first and second conductors; and a device responsive to an applied voltage to generate a plasma to perforate through the insulator to create an electrically conductive path between the first and second conductors;

(b) an assembly having conductors; a fuse link between the conductors; and insulation formed between the fuse link and each conductor, the fuse link coupled to receive a triggering voltage;

(c) assembly having a spark gap; a wire wound a plurality of turns around the spark gap; a first voltage coupled to the spark gap, the first voltage being less than an activation voltage of the spark gap; and a second voltage applied to the wire at a sufficient level to activate the spark gap;

(d) an assembly having conductors, an insulator, and a microelectromechanical device adapted to electrically connect the conductors when actuated, wherein the microelectromechanical device includes an actuator moveable by an applied electrical signal to move through the insulator and electrically connect the conductors; and (e) an assembly having conductors; an insulating layer separating the conductors; and a pressure actuated rod that when actuated in response to a predetermined pressure moves to electrically couple the conductors through the insulating layer.

12. A switching apparatus comprising:

a plurality of conductor layers;

at least an insulator layer separating the conductor layers; and a microelectromechanical device adapted to electrically connect the conductor layers when actuated, wherein the microelectromechanical device includes an actuator moveable by an applied electrical signal to move through the insulator layer and electrically connect the conductor layers.

13. A switch comprising:

conductors;

a fuse link between the conductors; and insulation formed between the fuse link and each conductor, the fuse link coupled to receive a triggering voltage.

14. The switch of claim 13, wherein the fuse link is adapted to go through a phase change in response to a predetermined voltage.

15. The switch of claim 14, wherein the phase change of the fuse link breaks down the insulation to create a conductive path between the conductors.

16. An activation device to activate an explosive, comprising:

a support structure;

an initiator formed on the support structure; and a switch formed with the initiator on the support structure to couple an applied voltage to the initiator, wherein the switch includes a multi-layered assembly including a plurality of electrical conductor layers and at least one insulator layer isolating the electrical conductor layers.

17. The switch of claim 16, wherein the switch further includes an element adapted to create a plasma in response to the applied voltage, the plasma providing an electrically conductive path between the conductors.

18. The switch of claim 17, wherein the element includes a device having a P/N junction.

19. The switch of claim 18, wherein the element includes a diode.

20. The switch of claim 17, wherein the element includes a bridge having a reduced electrically conductive area.

21. The switch of claim 16, wherein the switch includes a fuse link adapted to go through a phase change in response to a predetermined voltage.

22. The switch of claim 16, wherein the initiator includes an exploding foil initiator.

23. The switch of claim 16, wherein the switch includes a microelectromechanical element adapted to puncture through the insulator layer to electrically couple the conductor layers.

24. A switching system comprising:

a spark gap;

a wire wound a plurality of turns around the spark gap;

a first voltage coupled to the spark gap, the first voltage being less than an activation voltage of the spark gap; and a second voltage applied to the wire at a sufficient level to activate the spark gap.

25. Apparatus for use in a downhole tool, comprising:

a downhole component; and a switch including conductors and a microelectromechanical device adapted to electrically connect the conductors when actuated, wherein the microelectromechanical device includes an actuator moveable by an applied electrical signal to electrically connect the conductors, wherein the switch further includes a multilayered assembly including the conductors and an insulator, the actuator adapted to move through the insulator.

26. The apparatus of claim 25, wherein the switch is coupled to the downhole component.

27. The apparatus of claim 26, wherein the switch is adapted to be activated to operate the downhole component.

28. A switch comprising:

conductors;

an insulating layer separating the conductors; and a pressure actuated rod that when actuated in response to a predetermined pressure moves to electrically couple the conductors through the insulating layer.

29. A method of electrically coupling an electrical signal to a component in a downhole tool, comprising:

providing a multilayered switch assembly including a plurality of conductor layers and at least one insulator layer; and activating an element to create at least one electrical path by using a plasma to perforate through the at least one insulator layer to establish electrical conduction between the conductor layers.

30. The method of claim 29, wherein activating the element includes activating a device having a P/N junction.

31. The method of claim 30, wherein activating the element includes activating a diode.

32. The method of claim 29, wherein activating the element includes supplying a current through an electrically conductive bridge to vaporize the bridge.

33. A method of electrically coupling an electrical signal to a component in a downhole tool, comprising:

providing a switch selected from the group consisting of:

(a) an assembly having a first conductor and a second conductor; an insulator electrically isolating the first and second conductors; and a device responsive to an applied voltage to generate a plasma to perforate through the insulator to create an electrically conductive path between the first and second conductors;

(b) an assembly having conductors; a fuse link between the conductors; and insulation formed between the fuse link and each conductor, the fuse link coupled to receive a triggering voltage;

(c) an assembly having a spark gap; a wire wound a plurality of turns around the spark gap; a first voltage coupled to the spark gap, the first voltage being less than an activation voltage of the spark gap; and a second voltage applied to the wire at a sufficient level to activate the spark gap;

(d) an assembly having conductors, an insulator, and a microelectromechanical device adapted to electrically connect the conductors when actuated, wherein the microelectromechanical device includes an actuator moveable by an applied electrical signal to move through the insulator and electrically connect the conductors; and (e) an assembly having conductors; an insulating layer separating the conductors; and a pressure actuated rod that when actuated in response to a predetermined pressure moves to electrically couple the conductors through the insulating layer; and activating the switch to provide the electrical signal to the component.

* * * * *